US011668112B2

(12) United States Patent
Yang et al.

(10) Patent No.: US 11,668,112 B2
(45) Date of Patent: Jun. 6, 2023

(54) TENT

(71) Applicant: WEIZI E-COMMERCE (SHANGHAI) CO., LTD., Shanghai (CN)

(72) Inventors: Shengyong Yang, Shanghai (CN); Jing Bian, Shanghai (CN)

(73) Assignee: WEIZI E-COMMERCE (SHANGHAI) CO., LTD., Shanghai (CN)

( * ) Notice: Subject to any disclaimer, the term of this patent is extended or adjusted under 35 U.S.C. 154(b) by 41 days.

(21) Appl. No.: 17/073,428

(22) Filed: Oct. 19, 2020

(65) Prior Publication Data

US 2021/0032898 A1 Feb. 4, 2021

Related U.S. Application Data

(63) Continuation-in-part of application No. 16/461,797, filed as application No. PCT/CN2017/074022 on Feb. 18, 2017, now Pat. No. 10,844,626.

(30) Foreign Application Priority Data

Nov. 17, 2016 (CN) ..... 201611014097.7
Jan. 20, 2017 (CN) ..... 201710042277.4

(51) Int. Cl.
*E04H 15/60* (2006.01)
*E04H 15/46* (2006.01)
*E04H 15/48* (2006.01)

(52) U.S. Cl.
CPC ..... *E04H 15/60* (2013.01); *E04H 15/46* (2013.01); *E04H 15/48* (2013.01)

(58) Field of Classification Search
CPC ..... E04H 15/46; E04H 15/48; E04H 15/60
See application file for complete search history.

(56) References Cited

U.S. PATENT DOCUMENTS 2,949,814 A 8/1960 Boughton et al.
2,989,968 A * 6/1961 Gunter ..... A45B 19/04 248/408

(Continued)

FOREIGN PATENT DOCUMENTS

CN 203050229 U 7/2013
CN 203463439 U 3/2014

(Continued)

*Primary Examiner* — Noah Chandler Hawk
(74) *Attorney, Agent, or Firm* — Soroker Agmon Nordman PTE Ltd

(57) ABSTRACT

Disclosed is a tent that includes at least three telescopic stand columns. Each telescopic stand column has an inner tube and an outer tube sleevedly connected to each other, and a lock mechanism fixing the inner tube and the outer tube together. The inner tube has an open end portion inserted to the outer tube, and at least one side wall of the open end portion is opened with a strip-shaped opening. The lock mechanism has a tensioning component providing a tension to expand the open end portion outward along a direction perpendicular to a length direction of the inner tube, and a matching assembly fixed to the open end portion to fit with the tensioning component. Operation holes corresponding to the tensioning component are provided on side walls of the inner tube and outer tube.

10 Claims, 13 Drawing Sheets

(56) References Cited

U.S. PATENT DOCUMENTS

| | | | | | |
|---|---|---|---|---|---|
| 4,079,978 | A * | 3/1978 | McMullin | F16B 7/105 | 248/188.5 |
| 4,249,830 | A | 2/1981 | Day | | |
| 4,869,280 | A * | 9/1989 | Ewing | A61H 3/02 | 135/69 |
| 6,089,247 | A * | 7/2000 | Price | E04H 15/48 | 135/145 |
| 6,092,771 | A * | 7/2000 | Fich | A47B 9/06 | 248/407 |
| 6,508,262 | B1 | 1/2003 | Takayama | | |
| 6,575,656 | B2 * | 6/2003 | Suh | E04H 15/46 | 403/379.5 |
| 6,591,849 | B1 * | 7/2003 | Swetish | E04H 15/46 | 135/144 |
| 6,722,810 | B1 | 4/2004 | Tachikawa | | |
| 6,854,916 | B2 * | 2/2005 | Hsieh | F16B 7/105 | 403/109.1 |
| 6,874,971 | B2 | 4/2005 | Albaugh | | |
| 7,422,026 | B2 * | 9/2008 | Kim | E04H 15/50 | 135/120.2 |
| 9,974,366 | B2 * | 5/2018 | Heim | A63C 11/22 | |

FOREIGN PATENT DOCUMENTS

| | | | | |
|---|---|---|---|---|
| CN | 203702777 | U | 7/2014 | |
| EP | 1683975 | A1 * | 7/2006 | F16B 7/04 |

* cited by examiner

G-G

H-H

TENT

CROSS REFERENCE TO RELATED APPLICATIONS

The present application is a continuation-in-part application of U.S. patent application Ser. No. 16/461,797 filed on Feb. 18, 2017, the entire disclosure of which is hereby incorporated by reference in its entirety.

TECHNICAL FIELD OF THE INVENTION

The present disclosure relates to tent, in particular to a telescopic stand column used for tent and a tent having such telescopic stand column.

BACKGROUND OF THE INVENTION

Tent is mainly built in the outdoors, for shelter from wind, rain and sunshine or temporary living. The structure of tent generally includes covering fabric, a top support and stand columns, and for convenient transport and assembly, the top supports in the existing tents almost employ foldable structures. However, due to the stand column needs to bear a large weight, it generally has a fixed length and takes up a lot of space during transportation. Only for those lightweight tent structures, the stand columns are designed as telescopic structures.

In the prior art, the stand column of the telescopic structure mainly fixes the length of the stand column by a clamping member, such as a telescopic frame for tent disclosed in Chinese Invention Patent No. CN104196319A. However, during the use of the clamping member, due to the large local stress, it is very easy to be break, resulting in that the dangerous situation of the tent collapse sometimes occurs.

SUMMARY OF THE INVENTION

For this purpose, in order to overcome the defects of the prior art, the first object of the present disclosure is to provide a tent with more stable structure and greater bearing capacity.

To achieve the above purpose, firstly, the present disclosure provides a tent, comprising beams, a top tent frame and at leas three telescopic stand columns, each telescopic stand column comprises an inner tube and an outer tube sleevedly connected to each other, and a lock mechanism fixing the inner tube and the outer tube together, and the inner tube has an open end portion inserted into the outer tube, and at least one side wall of the open end portion is opened with a strip-shaped opening; the lock mechanism comprises a tensioning component providing a tensile force to expand the open end portion outward along a direction perpendicular to a length direction of the inner tube, and a matching assembly provided within the inner tube to fit with the tensioning component to tension the open end portion, and side walls of both the inner tube and outer tube are opened with operation holes corresponding to the tensioning component, the matching assembly comprises a first stop block and a second stop block respectively fixed to two side walls of the open end portion, and the tensioning component is movably connected along its own axial direction between the first stop block and the second stop block, and at least one of the first stop block and the second stop block is threaded connected with the tensioning component.

In a specific aspect, the tensioning component is a screw, and the screw is movably connected along its own axial direction between the first stop block and the second stop block, and at least one of the first stop block and the second stop block is threaded connected with the screw.

The strip-shaped openings are opened on the side walls of the opening end portion such that the side walls have a certain range of motion in the radial direction, and on this basis, the fitting of the tensioning component and the matching assembly causes the side walls of the opening end portion may be distended outwards or contracted inwards in a certain degree, to achieve the purpose of being compressed and fixed with the outer tube or being loosen. Due to that after being tensioned tightly, the inner tube and the outer tube are in surface-to-surface contact, with relatively greater friction force, and thus more stable, and having a greater bearing capacity.

Preferably, both the first stop block and the second stop block are provided with grooves, two ends of the screw movably penetrate into the groove of the first stop block and the groove of the second stop block, respectively, and at least one of the groove of the first stop block and the groove of the second stop block is provided with an internal threaded piece threaded connected with the screw.

In an embodiment, the inner tube has a section having at least three side walls, at least one of the side walls is provided with one strip-shaped opening, the first stop block is fixed at a corner formed by two adjacent side walls, the second stop block is fixed at the rest side wall(s).

In an embodiment, the section is triangle or pentagon shaped, at least a first and/or second side wall is provided with one strip-shaped opening, the first stop block is fixed at a corner formed by the first and second side walls, the second stop block is fixed at a third side wall opposite to the corner.

an embodiment, the inner tube has a section having at least three side walls, at least one of the side walls is provided with one strip-shaped opening, each two adjacent side walls forms a corner, the first stop block is fixed at one corner, the second stop block is fixed at another corner.

Preferably, the inner tube and the outer tube are both square tubes, four side walls of the inner tube are opened with a strip-shaped opening, respectively, the four strip-shaped openings divide the side walls of the open end portion of the inner tube into four corners, and the first stop block and the second stop block are correspondingly fixed at two corners on a same diagonal, respectively; its own axial direction of the screw is disposed along the same diagonal, and the operation holes are opened on the corner corresponding to one end of the screw.

In a specific embodiment, the first stop block and the second stop block are both provided with a clamping slot fitted with the corners; the first stop block and the second stop block are both divided into an inner side portion and an outer side portion by the clamping slot, the inner side portions are located within the inner tube, and the outer side portions are located between the inner tube and the outer tube. When the open end portion of the inner tube is expanded, a static friction force is generated from a pressing force between the outer side portions of the first stop block and the second stop block and the inner side walls of the outer tube, to fix the inner tube and the outer tube together. Therefore, the first stop block and the second stop block may employ a plastic block or a rubber block having a large frictional force.

In another specific aspect, one end of the screw is threaded connected with the first stop block, the other end of the screw is threaded connected with the second stop block, and directions of spiral of thread lines on the two ends of the screw are opposite.

preferably, both the first stop block and the second stop block are provided with grooves, two ends of the screw movably penetrate into the groove of the first stop block and the groove of the second stop block, respectively, the groove of the first stop block is provided with a first internal threaded piece therein, the groove of the second stop block is provided with a second internal threaded piece therein, an end of the screw is threaded connected with the first internal threaded piece, and the other end of the screw is threaded connected with the second internal threaded piece.

In yet another specific aspect, the tensioning component is a screw, and the matching assembly comprises a first sliding block and a second sliding block movably disposed along an axial direction of the screw, the screw is screw-thread fitted with the first sliding block and penetrates through the first sliding block to press against the second sliding block; the matching assembly further comprises a first push block sliding fitted with the first sliding block via a slope, a second push block sliding fitted with the second sliding block via a slope, and the first push block and the second push block are movably disposed within the inner tube along a direction perpendicular to the length direction of the inner tube, respectively.

Preferably, the inner tube and the outer tube are both square tubes, four side walls of the inner tube are opened with a strip-shaped opening, respectively, the four strip-shaped openings divide the side walls of the open end portion of the inner tube into four corners, and the first push block and the second push block are correspondingly disposed at two of the four corners, respectively.

Most preferably, there are two first push blocks, and the two first push blocks are located at two adjacent corners of the four corners, respectively; there are two second push blocks, and the two second push blocks are located at the other two adjacent corners of the four corners, respectively.

Preferably, the inner tube is further provided with an elastic locating piece, a side wall of the inner tube is opened with a through hole, the elastic locating piece has a locating protrusion movably disposed in the through hole and protruding outward, and a side wall of the outer tube is opened with a locating hole fitted with the locating protrusion.

In a specific embodiment, the elastic locating piece is a spring leaf, one end portion of the spring leaf is pressed against the side wall of the inner tube, and the other end portion of the spring leaf is integrally curved to form the locating protrusion.

In another specific embodiment, the elastic locating piece comprises a locating pin and a spring disposed within the inner tube, and one end of the locating pin has the locating protrusion. The elastic force of the spring cause the locating protrusion on one end of the locating pin to protrude out from the through hole on the side wall of the inner tube, and when the locating hole on the side wall of the outer tube is fitted with the locating protrusion on the locating pin, the inner tube and the outer tube are located.

More preferably, the lock mechanism further comprises a housing sleeved on an opening of the outer tube, and the housing is opened with a locating auxiliary hole corresponding to the locating hole on the outer tube for receiving the locating protrusion; the housing is opened with operation auxiliary holes corresponding to the operation holes. In a specific embodiment, the operating portion of the screw is an inner hexagonal hole, and therefore, by means of an inner hexagon bar wrench, the screw may be operated, and when the screw is tightened, the tensile force of the screw is increased to expand the inner tube outward, so that the inner tube and the outer tube are pressed and fixed together; when the screw is loosened, the tensile force of the screw is reduced, the inner tube is retracted automatically, and the pressing force between the inner tube and the outer tube is reduced, so that the inner tube and the outer tube can be telescoped and adjusted.

The upper part of the housing is provided with a limiting portion wrapped around the inner edge of the opening of the outer tube, and when the inner tube is extended and contracted with respect to the outer tube, the limiting portion blocks the locating protrusion, so that the inner tube can be prevented from easily coming out, and only when the locating protrusion is completely pressed into the inner tube, the inner tube can be pulled out from the opening of the outer tube.

In a specific aspect, the tensioning component is a screw, and the matching assembly comprises a first elastic tensioning piece and a second elastic tensioning piece respectively fixed to two side walls of the open end portion, and the screw is movably connected along an axial direction thereof between the first elastic tensioning piece and the second elastic tensioning piece, and at least one of the first elastic tensioning piece and the second elastic tensioning piece is threaded connected with the screw.

The strip-shaped openings are opened on the side walls of the opening end portion such that the side walls have a certain range of motion in the radial direction, and on this basis, the fitting of the tensioning component and the matching assembly causes the side walls of the opening end portion may be distended outwards or contracted inwards in a certain degree, to achieve the purpose of being compressed and fixed with the outer tube or being loosen. Due to that after being tensioned tightly, the inner tube and the outer tube are in surface-to-surface contact, with relatively greater friction force, and thus more stable, and having a greater bearing capacity.

In some specific embodiments, the inner tube and the outer tube are both square tubes, at least two of four side walls of the inner tube are opened with at least one strip-shaped opening, respectively, the at least two strip-shaped openings divide the side walls of the open end portion of the inner tube into at least two sidewall deformation portions, two sides of each sidewall deformation portion respectively comprise a side edge partitioned by the strip-shaped opening, two end portions of the first elastic tensioning piece are respectively connected between the two side edges of a first sidewall deformation portion, and two end portions of the second elastic tensioning piece are respectively connected between the two side edges of a second sidewall deformation portion. In order to increase the frication force of the inner tube and the outer tube, the sidewall deformation portions are respectively provided with wear-resistant parts or wear-resistant layers for frictional contact with the inner wall of the outer tube, such as rubber blocks or rubber sleeves or rubber coatings.

In some embodiments, the at least two strip-shaped openings divide the side walls of the open end portion of the inner tube into two U-shaped sidewall deformation portions, two sides of each sidewall deformation portion respectively comprise a corner, and each corner comprises at least one of the side edges, two end portions of the first elastic tensioning piece are respectively connected between the two corners of a first sidewall deformation portion, and two end portions of the second elastic tensioning piece are respectively connected between the two corners of a second sidewall deformation portion.

Preferably, the first elastic tensioning piece comprises first connecting sections located at two sides and correspondingly connected the two side edges of the first sidewall deformation portion, and a first elastic deformation section connected between the first connecting sections of the two sides; the second elastic tensioning piece comprises second connecting sections located at two sides and correspondingly connected the two side edges of the second sidewall deformation portion, and a second elastic deformation section connected between the second connecting sections of the two sides.

In some specific embodiments, the first elastic deformation section and the second elastic deformation section are disposed opposing each other and curved inward, respectively.

In some embodiments, a first end portion of the screw is threaded connected with and penetrates through one of the first elastic tensioning piece and the second elastic tensioning piece, and a second end portion of the screw is pressed against the other one of the first elastic tensioning piece and the second elastic tensioning piece.

In some other embodiments, two ends of the screw are threaded connected with the first elastic tensioning piece and the second elastic tensioning piece, respectively, and directions of spiral of thread lines on the two ends of the screw are opposite.

Preferably, the inner tube is further provided with an elastic locating piece, aside wall of the inner tube is opened with a through hole, the elastic locating piece has a locating protrusion movably disposed in the through hole and protruding outward, and a side wall of the outer tube is opened with a locating hole fitted with the locating protrusion.

In a specific embodiment, the elastic locating piece comprises a locating pin and a spring disposed within the inner tube, and one end of the locating pin has the locating protrusion. The elastic force of the spring cause the locating protrusion on one end of the locating pin to protrude out from the through hole on the side wall of the inner tube, and when the locating hole on the side wall of the outer tube is fitted with the locating protrusion on the locating pin, the inner tube and the outer tube are located.

Compared with the prior art, after the telescopic stand column of the present disclosure is extended to a certain length, by operating the tensioning component via a tool, the tensioning component is fitted with the matching assembly, so that the open end portion of the inner tube is expanded outward along a direction perpendicular to the length direction, the open end portion of the inner tube is pressed against the outer tube after being expanded, so that the inner tube and the outer tube are tightly fastened and fixed together, and there is a large frictional force between the two fastened surfaces, resulting in that the telescopic stand column structure is more stable and the bearing capacity thereof is larger, which can ensure a more stable support effect of the telescopic stand column.

In an embodiment, the beams are formed by connecting a plurality of connecting rods successively.

In an embodiment, the top tent frame comprises a top connector and a plurality of top rods connected to the top connector, an upper end of each top rod is connected to the top connector, and each of the top rods extends aslant downward; lower portions of some of the plurality of top rods are connected to upper ends of the telescopic stand columns, and lower portions of the rest top rods are connected to the beams.

In an embodiment, the top connector has a plurality of connecting interfaces regularly spaced along a same circumference, and the upper end of each top rod is connected to one corresponding connecting interface.

In a specific embodiment, there are four telescopic stand column, and a cubic frame is formed by connecting one beam between two telescopic stand columns. The top tent frame is fixed on the cubic frame formed by the telescopic stand columns and the beams.

Compared to the prior art, the tent provided by the present disclosure employs the telescopic stand column, it has a more stable structure, is more convenient for installation, and has a smaller packaging volume.

Figure 1:
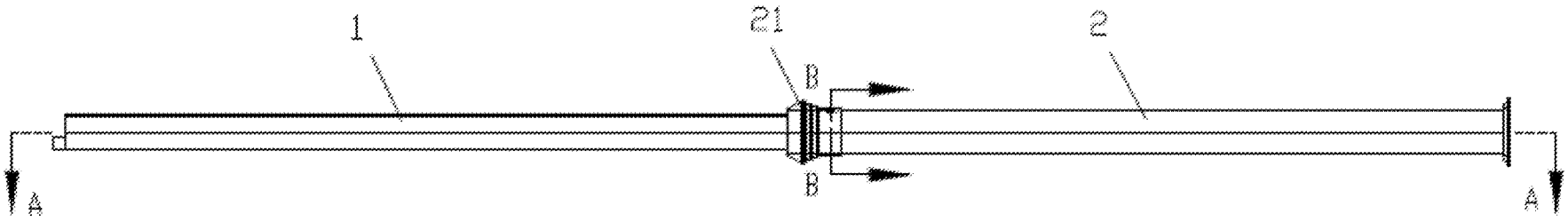
FIG. 1 is a main view of a telescopic stand column of Embodiment 1.
Figure 2:
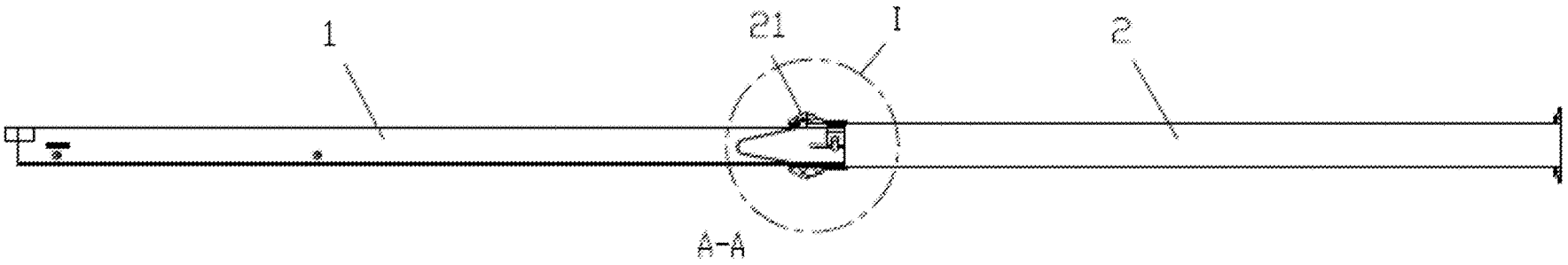
FIG. 2 is a sectional view along Line A-A in FIG. 1.

wherein:

1—inner tube, 10—telescopic stand column, 11—open end portion, 12—strip-shaped opening, 13—screw, 14—first stop block, 15—second stop block, 2—outer tube, 21—housing; 16—internal threaded piece, 161—first internal threaded piece, 162—second internal threaded piece, 151—operating hole, 101—operation hole, 102—operation hole, 17—corner, 18—elastic locating piece, 181—locating protrusion, 19—pin, 191—locating protrusion, 20—spring, 211—locating auxiliary hole, 212—limit portion, 3—beam, 4—top tent frame, 41—top connector, 5—top rod, 6—inclined support rod, 7—beam, 71—connecting rod, 72—vertical rod, 8—covering fabric;

10—inner tube, 100—telescopic stand column, 110—open end portion, 101—operation hole, 120—strip-shaped opening, 130—screw, 140—first elastic tensioning piece, 150—elastic tensioning piece, 20—outer tube, 210—housing; 160—internal threaded piece, 170—corner, 190—pin shaft, 191—locating protrusion, 200—spring, 211—locating auxiliary hole, 213—button, 214—end cover, 30—beam, 40—top tent frame, 410—top connector, 411—connecting interface, 50—top rod, 60—inclined support rod.

DETAILED DESCRIPTION OF EXEMPLARY EMBODIMENTS

In the following, the preferable embodiments according to the present disclosure are explained in detail combining with the accompanying drawings.

Embodiment 1

Referring to FIGS. 1 to 4*a*, the telescopic stand column 10 of the present embodiment comprises an inner tube 1 and an outer tube 2 sleevedly connected to each other, and a lock mechanism fixing the inner tube 1 and the outer tube 2 together. The inner tube 1 has an open end portion 11 inserted into the outer tube 2, and at least one side wall of the inner tube 1 is opened with a strip-shaped opening 12, the strip-shaped opening 12 extends to the edge of the opening along a longitudinal direction. The lock mechanism comprises a tensioning component providing a tensile force to expand the open end portion 11 outward along a direction perpendicular to a length direction of the inner tube 1, and a matching assembly provided within the inner tube 1 to fit with the tensioning component to tension the open end portion 11, and side walls of both the inner tube 1 and outer tube 2 are opened with operation holes corresponding to the tensioning component.

Figure 3:
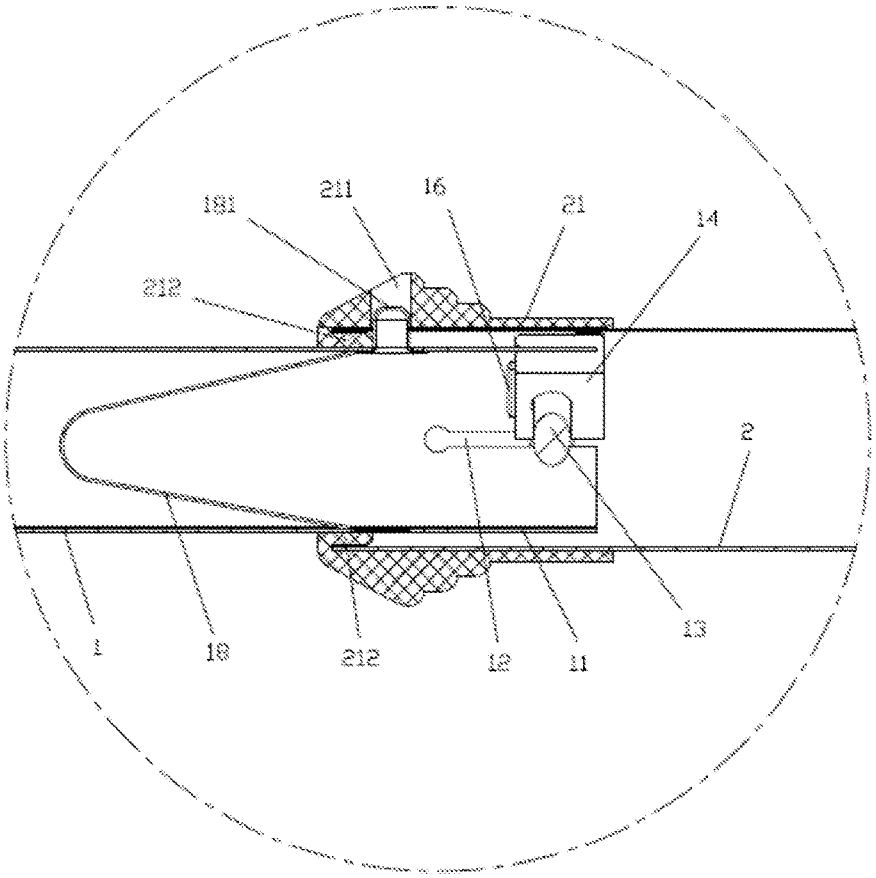
FIG. 3 is an enlarged view of Part I in FIG. 2.
Figure 4A:
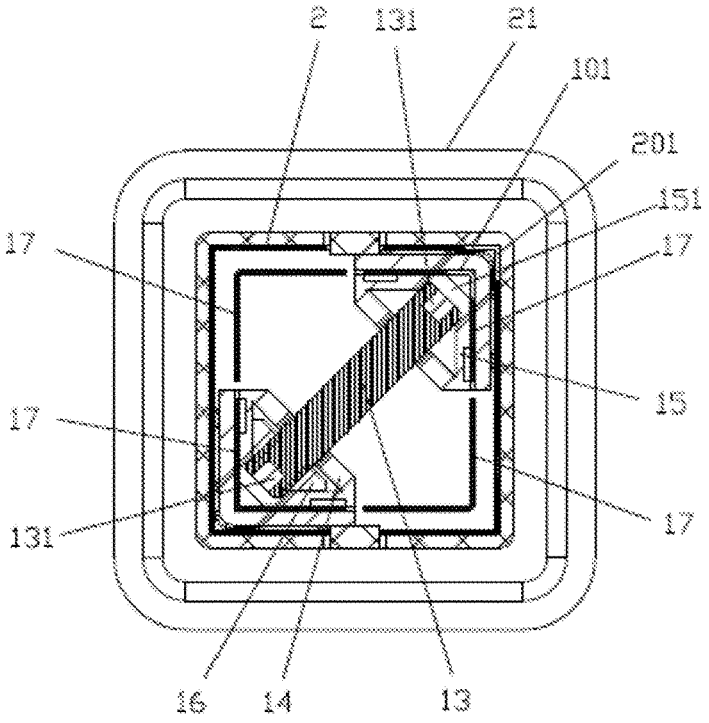
FIG. 4*a* is an enlarged sectional view along Line B-B in FIG. 1.

Wherein, the tensioning component is a screw 13, and the matching assembly comprises a first stop block 14 and a second stop block 15 respectively fixed to two side walls of the open end portion 11, and the screw 13 is movably connected along its own axial direction between the first stop block 14 and the second stop block 15, and at least one of the first stop block 14 and the second stop block 15 is threaded connected with the screw 13. As shown in FIGS. 3 and 4*a*, both the first stop block 14 and the second stop block 15 are provided with grooves, two ends of the screw 13 movably penetrate into the groove of the first stop block 14 and the groove of the second stop block 15, respectively, and in the present embodiment, only the groove of the first stop block 14 is provided with an internal threaded piece 16 threaded connected with the screw 13.

The second stop block 15 is opened with an operation hole 151 into which an end portion of the screw 13 is inserted, a side wall of the inner tube 1 is opened with an operation hole 101 corresponding to the end of the screw 13 penetrating into the second stop block 15, a side wall of the outer tube 2 is opened with an operation hole 201 corresponding to the end of the screw 13 penetrating into the second stop block 15, the end portion of the screw 13 corresponding to the operation holes 151, 101 and 201 is provided with an operation portion, and in the present embodiment, the operation portion is an internal hexagonal hole 131. The diameter of the screw 13 should be greater than the diameter of the operation hole 151 in the second stop block 15, to prevent the screw 13 from coming off. Moreover, when the screw 13 is tightened, its end portion is in contact with the second stop block 15, so that the second stop block 15 provides a force bearing point to the screw 13. When the telescopic length of the inner tube 1 is adjusted until the three operation holes 151, 101 and 201 are aligned, the screw 13 can be operated by inserting an internal hexagonal wrench, and the screw 13 can be tightened to expand the open end portion 1 of the inner tube 1 outward.

The strip-shaped opening 12 is opened on the side wall of the open end portion so that the side wall of the open end portion 11 can have a certain open-close capacity in the radial direction. Consequently, the function of the screw 13 causes the side walls of the opening end portion 11 may be distended outwards or contracted inwards in a certain extent, to achieve the purpose of compressing and fixing the inner tube 1 with the outer tube 2 together or loosening them.

In the present embodiment, as shown in FIG. 4*a*, the inner tube 1 and the outer tube 2 are both square tubes, four side walls of the inner tube 1 are opened with a strip-shaped opening 12, respectively, the four strip-shaped openings 12 divide the side walls of the open end of the inner tube 1 into four corners 17. The first stop block 14 and the second stop block 15 are correspondingly fixed at two corners 17 on a same diagonal, respectively. Its own axial direction of the screw 13 is disposed along the same diagonal where the first stop block 14 and the second stop block 15 are located. The operation hole 101 of the inner tube 1 is opened on the corner 17 where the second stop block 15 is located.

Figure 4B:
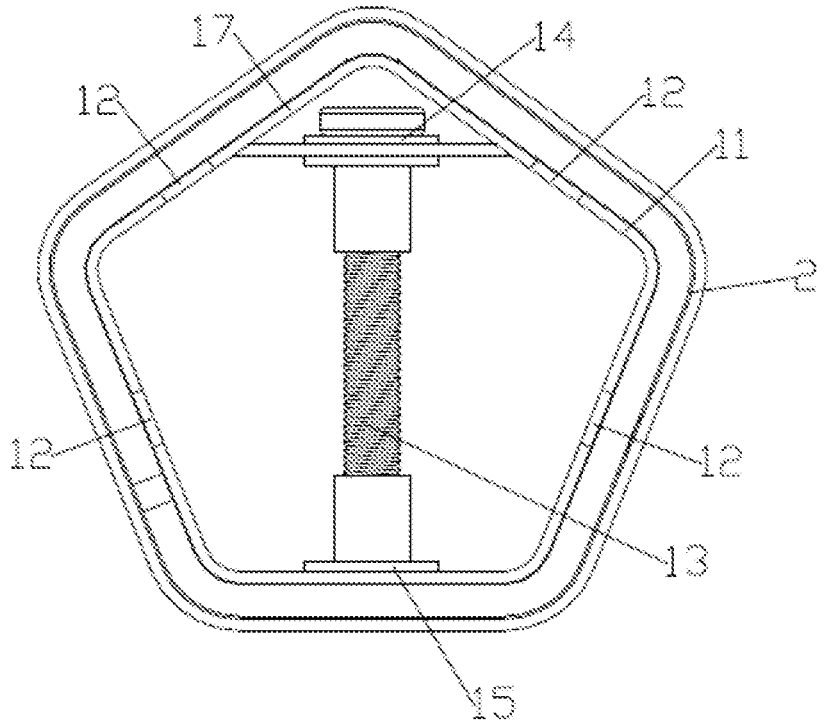
FIG. 4*b* is a sectional view of another telescopic stand column.

In another embodiment, both the inner tube 1 and the outer tube 2 have a section having at least three side walls (such as three or five), at least one of the side walls is provided with one strip-shaped opening 12, the first stop block 14 is fixed at a corner 17 formed by two adjacent side walls, the second stop block 15 is fixed at the rest side wall(s). As shown in FIG. 4*b*, the section is pentagon shaped, a first, second, fourth and fifth side walls are provided with one strip-shaped opening 12, respectively, the first stop block 14 is fixed at the corner 17 formed by the first and second side walls, the second stop block 15 is fixed at a third side wall opposite to the corner 17.

Figure 4C:
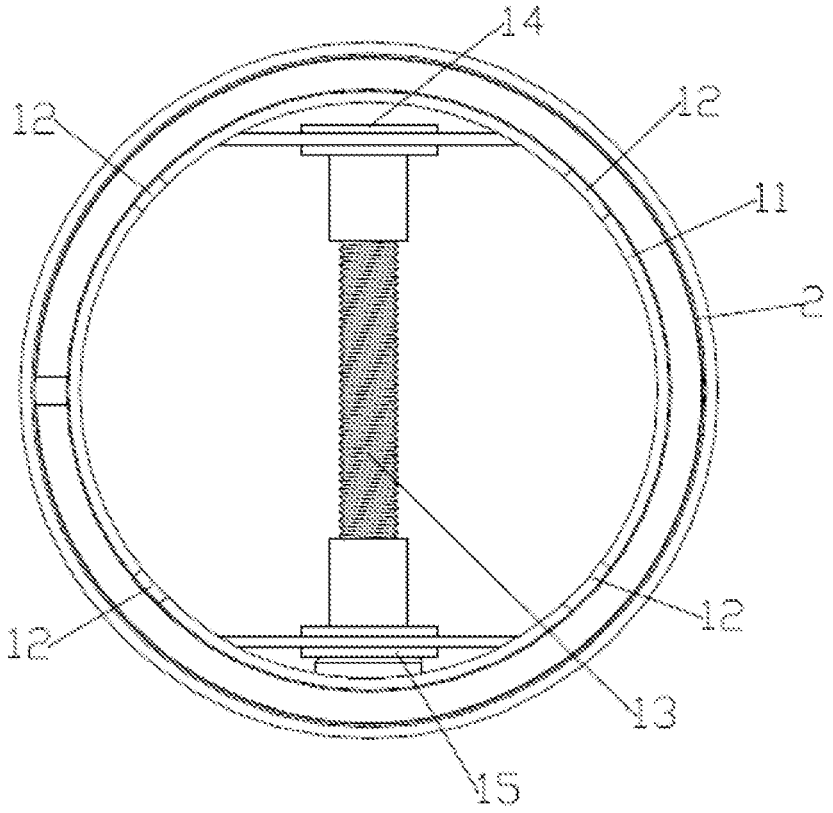
FIG. 4*c* is a sectional view of yet another telescopic stand column.

In yet another embodiment, as shown in FIG. 4*c*, both the inner tube 1 and the outer tube 2 are circular tube, four strip-shaped openings 12 are provided on the inner tube 1, the first stop block 14 is fixed between two strip-shaped openings 12, the second stop block 15 is fixed between the other two strip-shaped openings 12.

The first stop block 14 and the second stop block 15 are both provided with a clamping slot fitted with the corners 17. The first stop block 14 and the second stop block 15 are both divided into an inner side portion and an outer side portion by the clamping slot, the inner side portions are located within the inner tube 1, and the outer side portions are located between the inner tube 1 and the outer tube 2. When the open end portion of the inner tube 1 is expanded, a static friction force is generated from a pressing force between the outer side portions of the first stop block 14 and the second stop block 15 and the inner side walls of the outer tube 2, to fix the inner tube and the outer tube together. In the present embodiment, the first stop block 14 and the second stop block 15 are made of rubber blocks. When installing, the internal threaded piece 16 is firstly placed in the groove of the first stop block 14, and then the threaded end of the screw 13 penetrates into the first stop block 14 and is threaded connected with the internal threaded piece 16, and then the other end of the screw 13 penetrates into the second stop block 15, and the first stop block 14 and the second stop block 15 are respectively clamped into the opposite corners 17 of the open end portion 11 of the inner tube 1 through their own clamping slots.

In order to facilitate locating when adjusting the telescopic position of the inner tube, the inner tube 1 is further provided with an elastic locating piece 18 therein, a side wall of the inner tube 1 is opened with a through hole, the elastic locating piece 18 has a locating protrusion 181 movably disposed in the through hole and protruding outward, and a side wall of the outer tube 2 is opened with a locating hole fitted with the locating protrusion 18. Wherein, the elastic locating piece 18 is a spring leaf, one end portion of the spring leaf is pressed against the side wall of the inner tube 1, and the other end portion of the spring leaf is integrally curved to form the locating protrusion 181. When the locating protrusion 181 of the elastic locating piece 18 is fitted with the locating hole on the outer tube 2, the operation hole 151 on the second stop block 15, the operation hole 101 of the inner tube 1 and the operation hole 201 of the outer tube 2 are just aligned, at which point the tool can be inserted to operate the screw 13.

The lock mechanism further comprises a housing 21 sleeved on an opening of the outer tube 2, and the housing 21 is opened with a locating auxiliary hole 211 corresponding to the locating hole for receiving the locating protrusion 181. The housing 21 is opened with operation auxiliary holes corresponding to the operation hole 201 on the outer tube 2. When operating to lock the inner tube 1 and the outer tube 2, the inner tube 1 and the outer tube 2 are firstly adjusted to a suitable length, and then the locating protrusion 181 of the elastic locating piece 18 leaps from the inner tube and gets stuck in the locating auxiliary hole 211. When the internal hexagonal wrench penetrates the operation auxiliary hole on the housing 21, the operation hole 201 on the outer tube 2, the operation hole 101 on the inner tube 1 and the operation hole 151 of the second stop block 15 successively, and tightens the screw 13, an increase in a tensile force generated by separating the screw 13 from the internal threaded piece 16 expands the inner tube 1 outward, and thus the inner tube 1 and the outer tube 2 are tightly pressed and fixed together. When loosening the screw 13, the screw 13 and the internal threaded piece 16 get close to each other, and the tensile force between them decreases, the inner tube 1 is retracted automatically, and the pressing force between the inner tube 1 and the outer tube 2 is reduced, so that the inner tube 1 and the outer tube 2 can be telescoped and adjusted.

The upper part of the housing 21 is provided with a limiting portion 212 wrapped around the inner edge of the opening of the outer tube 2, and when the inner tube 1 is extended and contracted with respect to the outer tube 2, the limiting portion 212 blocks the locating protrusion 181, so that the inner tube 1 can be prevented from easily coming out, and only when the locating protrusion 181 is completely pressed into the inner tube 1, the inner tube 1 can be pulled out from the opening of the outer tube 2. Therefore, during transportation, the inner tube 1 and the outer tube 2 can be contracted to the shortest, or both can be taken apart to reduce the package length.

After the telescopic stand column 10 of the present embodiment is extended to a longest length, the inner tube 1 and the outer tube 2 are located by using the elastic locating piece 18, and by screwing the screw 13 tightly via a tool penetrating into the lock mechanism, the open end portion of the inner tube 1 is expanded outward, the open end portion of the inner tube 1 is pressed against the outer tube 2 after being expanded, so that the inner tube 1 and the outer tube 2 are tightly fastened and fixed together, resulting in that the structure of the telescopic stand column 10 is more stable and the bearing capacity thereof is larger, which can ensure the more stable support effect of the telescopic stand column. When using the telescopic stand column 10, it may be the outer tubes 2 which support on the ground and the inner tubes 1 are located above; it also may be the inner tubes 1 which support on the ground and the outer tubes are located above.

Embodiment 2

Figure 5:
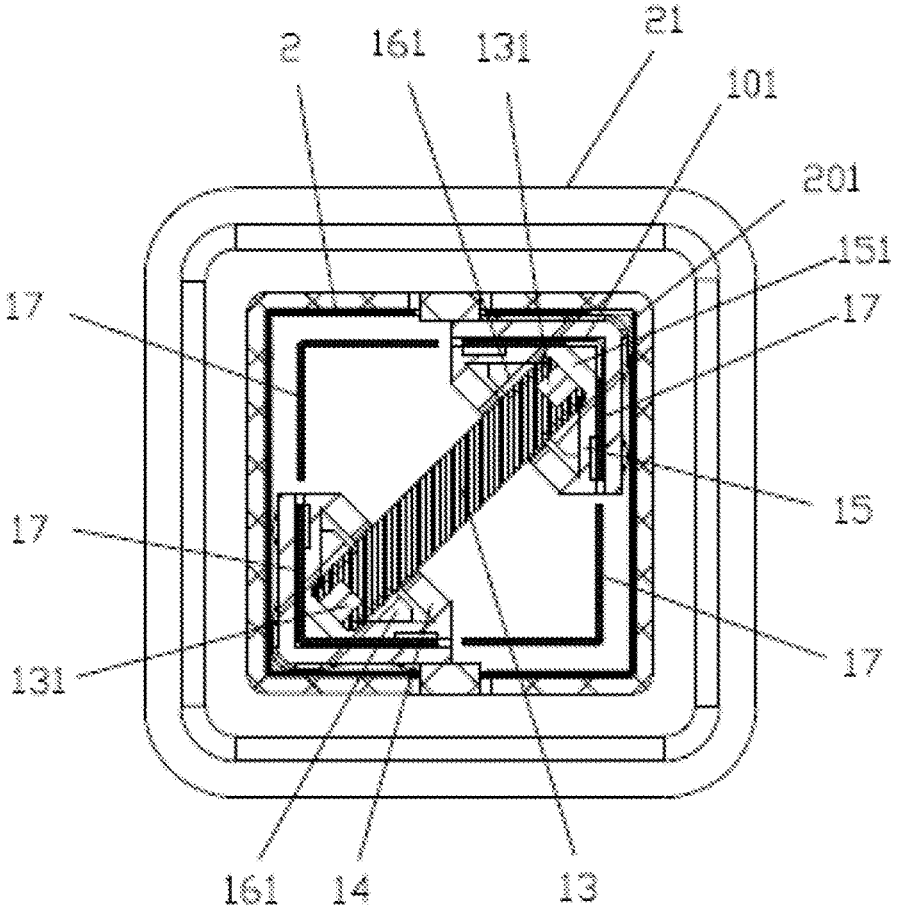
FIG. 5 is a schematic sectional view of a lock mechanism of a telescopic stand column of Embodiment 2.

The structure of the telescopic stand column of the present embodiment is substantially the same with that of Embodiment 1, by differing in that: in present embodiment, both the first stop block 14 and the second stop block 15 are provided with grooves, two ends of the screw 13 movably penetrate into the groove of the first stop block 14 and the groove of the second stop block 15, respectively, the groove of the first stop block 14 is provided with a first internal threaded piece 161 therein, the groove of the second stop block 15 is provided with a second internal threaded piece 162 therein, an end of the screw 13 is threaded connected with the first internal threaded piece 161, and the other end of the screw 13 is threaded connected with the second internal threaded piece 162, and directions of spiral of thread lines on the two ends of the screw 13 are opposite. As shown in FIG. 5, due to that the directions of spiral of thread lines on the two ends of the screw 13 are opposite, when screwing the screw 13, the directions of motion of the first internal threaded piece 161 and the second internal threaded piece 162 are opposite, that is, when screwing the screw 13, the first internal threaded piece 161 and the second internal threaded piece 162 are away from each other or get close to each other. When screwing the screw 13, the first internal threaded piece 161 and the second internal threaded piece 162 are away from each other, and respectively push the first stop block 14 and the second stop block 15 away from each other, and thus the open end portion 11 of the inner tube 1 is expanded outward and tightly locked and fixed with the outer tube 2. When loosening the screw 13, the first internal threaded piece 161 and the second internal threaded piece 162 get close to each other, and causes the open end portion 11 of the inner tube 1 to leave each other, the inner tube 1 may be retracted into the outer tube 2, or the inner tube 1 may be detached from the outer tube 2.

Embodiment 3

Figure 6:
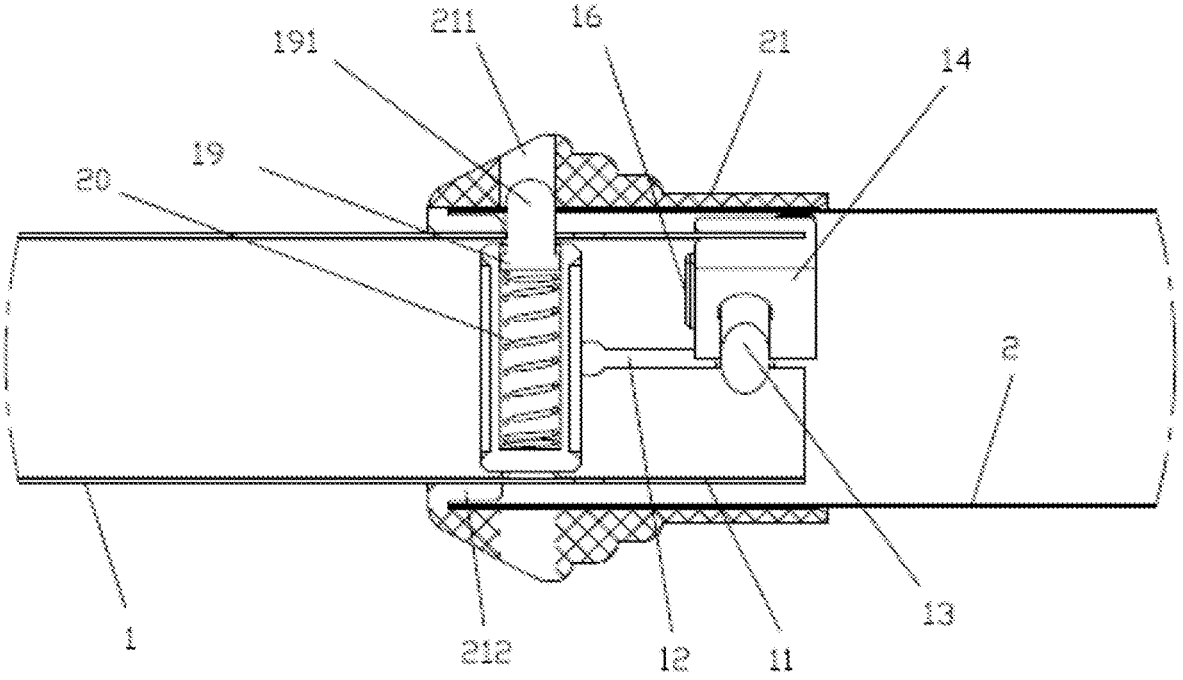
FIG. 6 is a schematic sectional view of a lock mechanism of a telescopic stand column of Embodiment 3.
Figure 7:
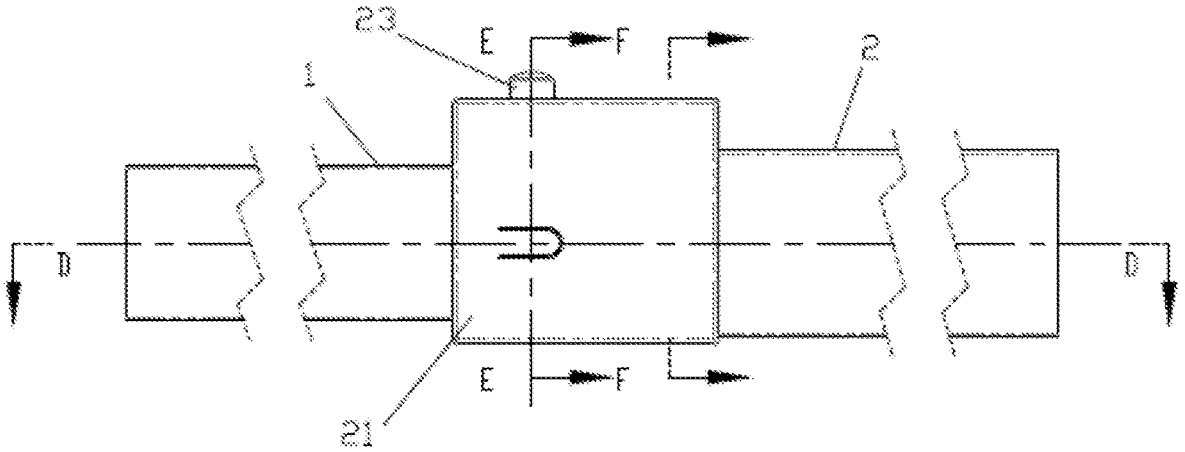
FIG. 7 is a main view of a telescopic stand column of Embodiment 4.
Figure 8:
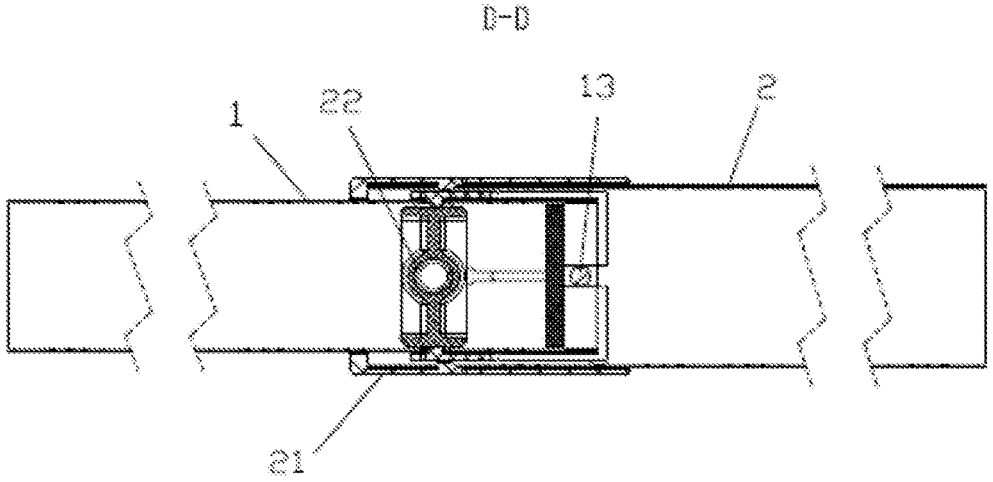
FIG. 8 is a sectional view along Line D-D in FIG. 7.
Figure 9:
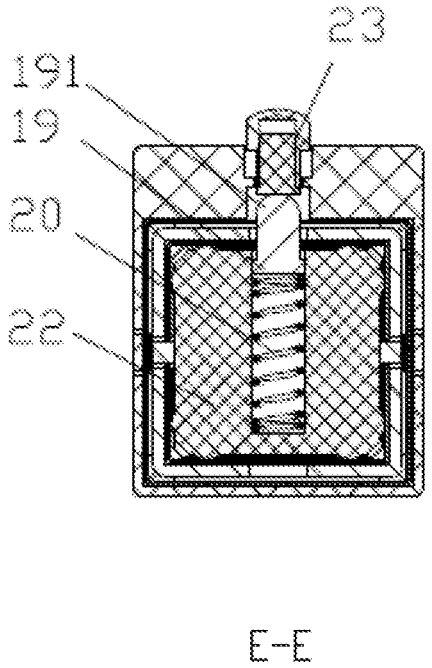
FIG. 9 is a sectional view along Line E-E in FIG. 7.
Figure 10:
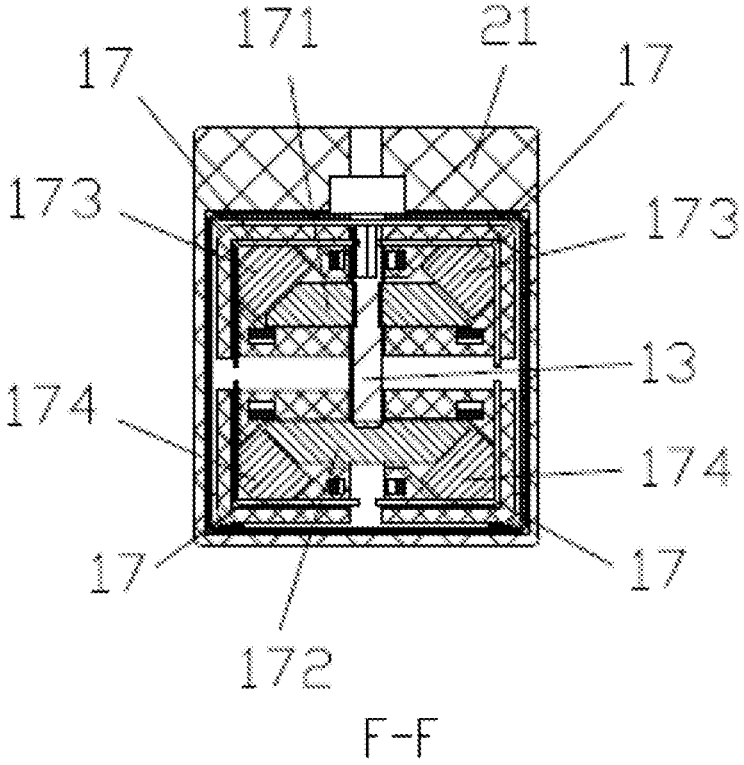
FIG. 10 is a sectional view along Line F-F in FIG. 7.

The structure of the telescopic stand column of the present embodiment is substantially the same with that of Embodiment 1, by differing in that: as shown in FIG. 6, the elastic locating piece disposed within the inner tube 1 comprises a pin 19 and a spring 20, and one end of the pin 19 has the locating protrusion 191 protruding outward and movably disposed within the through hole of the inner tube 1, the spring 20 and the pin are mounted on a guide holder, and the side wall of the outer tube 2 is provided with a locating hole fitted with the locating protrusion 191. When the inner tube 1 and the outer tube 2 are retracted, the pin 19 retracts into the inner tube 1 against the elastic force of the spring 20; when the inner tube 1 and the outer tube 2 are extended to the locating protrusion 191 and fitted with the locating hole on the outer tube 2, the operation hole 151 on the second stop block 15, the operation hole 101 of the inner tube 1 and the operation hole 201 of the outer tube 2 are just aligned, at which point the tool can be inserted to operate the screw 13. The locating of the spring 20 and the pin 19 is more stable than the approach of locating by the spring leaf of Embodiment 1.

Embodiment 4

Figure 11:
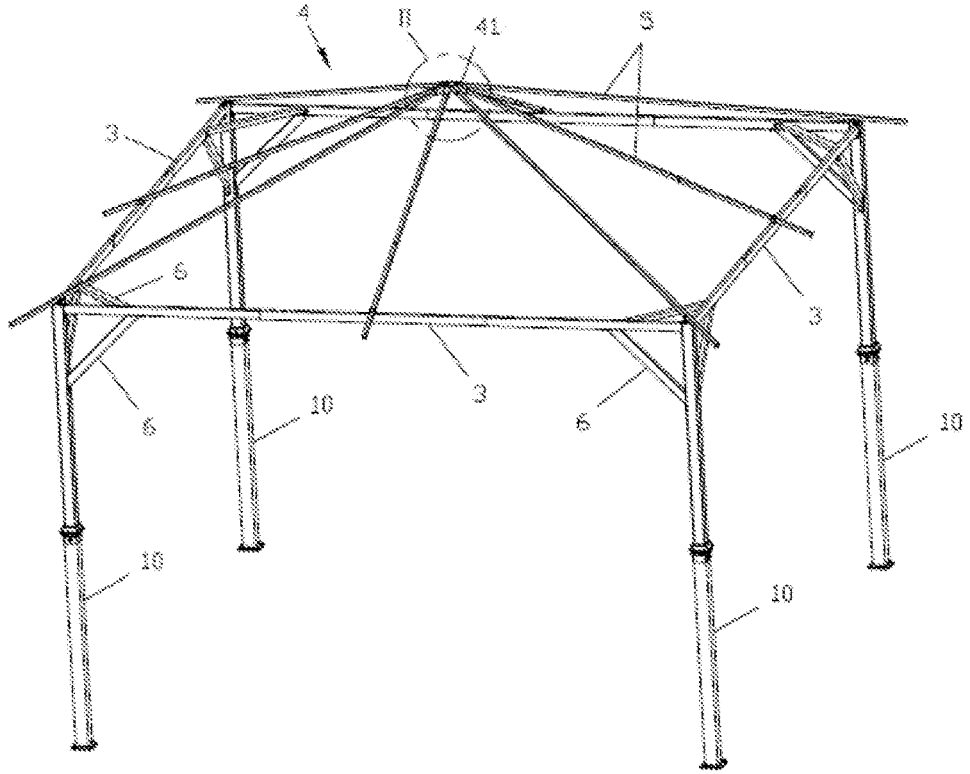
FIG. 11 is a stereo view of a tent (without covering fabric) of Embodiment 5.

The structure of the telescopic stand column of the present embodiment is substantially the same with that of Embodiment 1, by differing in that: as shown in FIGS. 7 to 10, the screw 13 is disposed along a direction parallel to one side of the inner tube 1, and the matching assembly comprises a first sliding block 171 and a second sliding block 172 movably disposed along an axial direction of the screw 13, the screw 13 is screw-thread fitted with the first sliding block 171 and penetrates through the first sliding block 171 to press against the second sliding block 172; the matching assembly further comprises two first push blocks 173 sliding fitted with the first sliding block 171 via slopes, and two second push blocks 174 sliding fitted with the second sliding block 172 via slopes, and the first push blocks 173 and the second push blocks 174 are movably disposed within the inner tube 1 along the direction perpendicular to the length direction of the inner tube 1, respectively; specifically, the two first push blocks 173 are located at two adjacent corners 17 of the four corners 17, respectively, and the two second push blocks 174 are located at the other two adjacent corners 17 of the four corners 17, respectively, and an first push block 173 and second push block 174 opposing to each other are located on the same diagonal line, and are respectively slidably disposed in the inner tube 1 in a diagonal direction; in addition, as shown in FIG. 11, the elastic locating piece employs a substantially same structure with Embodiment 3, the elastic locating piece disposed within the inner tube 1 comprises a pin 19 and a spring 20, and one end of the pin 19 has the locating protrusion 191 protruding outward and movably disposed within the through hole of the inner tube 1, the spring 20 and the pin are mounted on a guide holder 22, wherein a side of the guide holder 22 is clamped within the side wall of the inner tube 1; on the side wall of the outer tube 2 is provided the locating hole fitted with the locating protrusion 191; the housing 21 is further provided with a button for operating the locating protrusion 191, and after the button 23 is pressed down, the pin 19 is driven against the elastic force of the spring 20 to retract the locating protrusion 191 into the inner tube 1, and thus the inner tube 1 and the outer tube 2 may be elongated and shortened.

When locking the telescopic stand column of the present embodiment, the pin 19 and the spring 20 are used to locate the inner tube 1 and the outer tube 2, and the screw 13 is screwed tightly via a tool penetrating into the lock mechanism to drive the first sliding block 171 and the second sliding block 172 away from each other, the first sliding block 171 pushes the two first push blocks 173 respectively via the slopes provided at the end portions to press against the two corners 17 outward along the diagonal direction of the inner tube 1, the second sliding block 172 pushes the two second push blocks 174 respectively via the slopes provided at the end portions to press against the other two corners 17 outward along the diagonal direction of the inner tube 1, so that the open end portion is expanded outward along the direction perpendicular to the length direction of the inner tube, the open end portion of the inner tube 1 is pressed against the outer tube 2 after being expanded, so that the inner tube 1 and the outer tube 2 are tightly fastened and fixed together, resulting in that the structure of the telescopic stand column 10 is more stable and the bearing capacity thereof is larger, which can ensure a more stable support effect of the telescopic stand column. In the present embodiment, the force of the tensioning component in a single direction is converted into a force that expands the four corners outward along the diagonal lines by the fitting of the slopes between the sliding blocks and the push blocks, thereby achieving a more stable implementation of the lock between the inner tube 1 and the outer tube 2.

Embodiment 5

As shown in FIG. 11, the present embodiment provides a tent, comprising beams 3, a top tent frame 4 and covering fabric, and it further comprises the telescopic stand column 10 of Embodiment 1 or 2, wherein there are four telescopic stand columns 10, and the beams 3 are connected between two telescopic stand columns 10, respectively. Two telescopic stand columns 10 are connected via one beam 3, and the four telescopic stand columns 10 are connected via four beams 3 successively to form a cubic frame. The top tent frame 4 is fixed on the cubic frame formed by the telescopic stand columns 10 and the beams 3, and the top tent frame 4 comprises a top connector 41 and a plurality of top rods 5 connected to the top connector 41, an upper end of each top rod 5 is respectively connected to the top connector 41, and each of the top rods 5 extends aslant downward; lower portions of some of the plurality of top rods 5 are connected to upper ends of the telescopic stand columns 10, and lower portions of the rest top rods 5 are connected to the beams 3. There are eight top rods 5, wherein four top rods 5 are connected to the top connector 41 and respectively to the upper end of corresponding one of the telescopic stand columns 10, and the other four top rods 5 are connected to the top connector 41 and respectively to the middle of the corresponding one of the beams 3.

Wherein, the beams 3 are all formed by connecting a plurality of connecting rods successively. Each beam 3 and telescopic stand column 10 are provided with an inclined support rod 6. The two beams 2 connected to the same telescopic stand column 10 are perpendicular to each other, and the two beams 2 are also provided with an inclined support rod 6. The two inclined support rods 6 on the same telescopic stand column 10, and the inclined support rod 6 between the two beams 2 on the same telescopic stand column 10 form a triangle. The connection of the inclined support rods 6 may strengthen the strength of the cubic frame, causes the integral structure more stable.

In order to facilitate the packaging and transportation, the top rods 5 are also formed by connecting a plurality of connecting rods successively.

Figure 12:
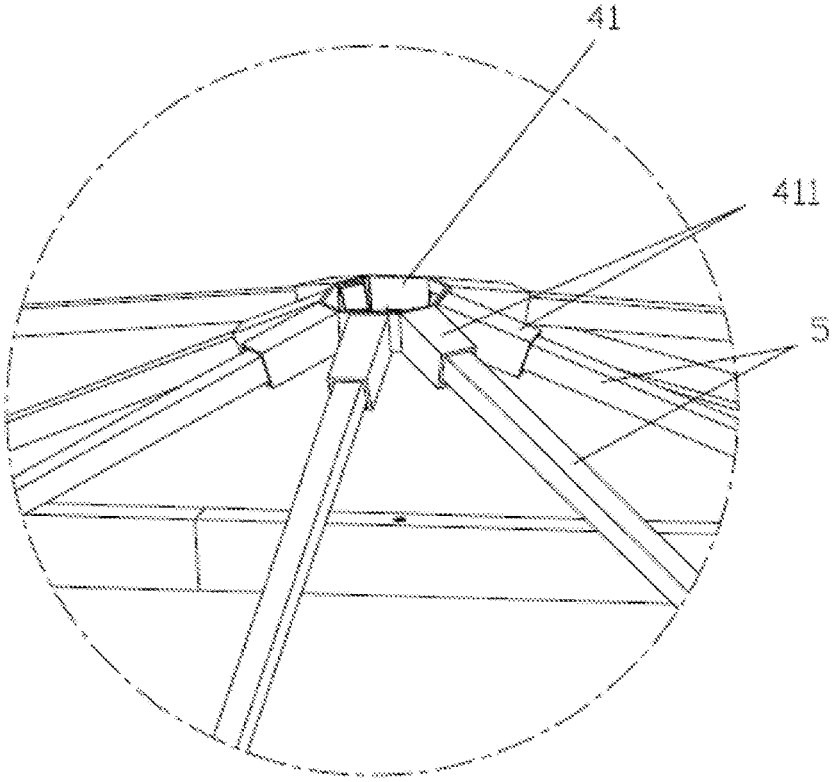
FIG. 12 is an enlarged view of Part II in FIG. 11.

As shown in FIG. 12, the top connector 41 has eight connecting interfaces 411 regularly spaced along the same circumference, and the upper end of each top rod 5 is connected to one corresponding connecting interface 411. The height of the top connectors 41 is higher than that of the beams 3 and the telescopic stand columns 10.

When assembling the tent of the present embodiment, the assembly can be completed by only two people, the telescopic columns 10 are assembled first, and the telescopic columns 10 are contracted to the shortest length, and then the beams 3 are connected between the telescopic stand columns 10 to form a cubic frame, then, the assembled top tent frame 4 is mounted on the cubic frame, the covering fabric is covered thereon, and then the length of the telescopic columns 10 is elongated, and then the telescopic stand columns 10 are locked by the lock mechanism, to finish the assembly of the tent, which is very convenient. Since each of the telescopic stand columns 10 is telescopic, the beams 3 and the top rods 5 can also be detached into parts with shorter length, which greatly reduces the packaging volume and is convenient for transportation and storage.

Embodiment 6

Figure 13:
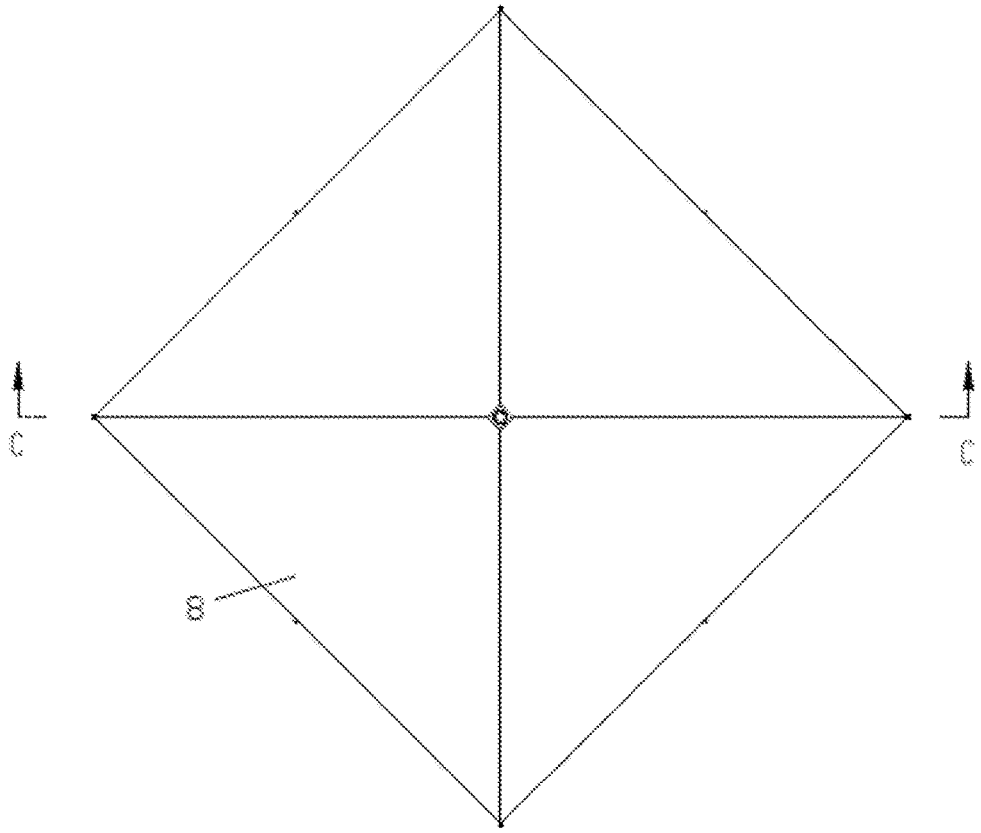
FIG. 13 is a top view of a tent of Embodiment 6.
Figure 14:
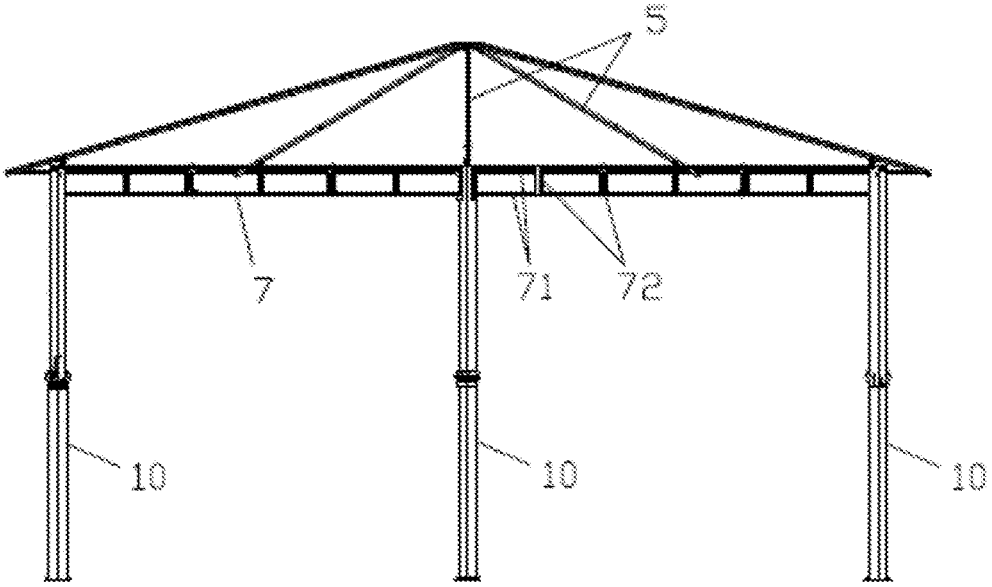
FIG. 14 is a sectional view along Line C-C in FIG. 13.
Figure 15:
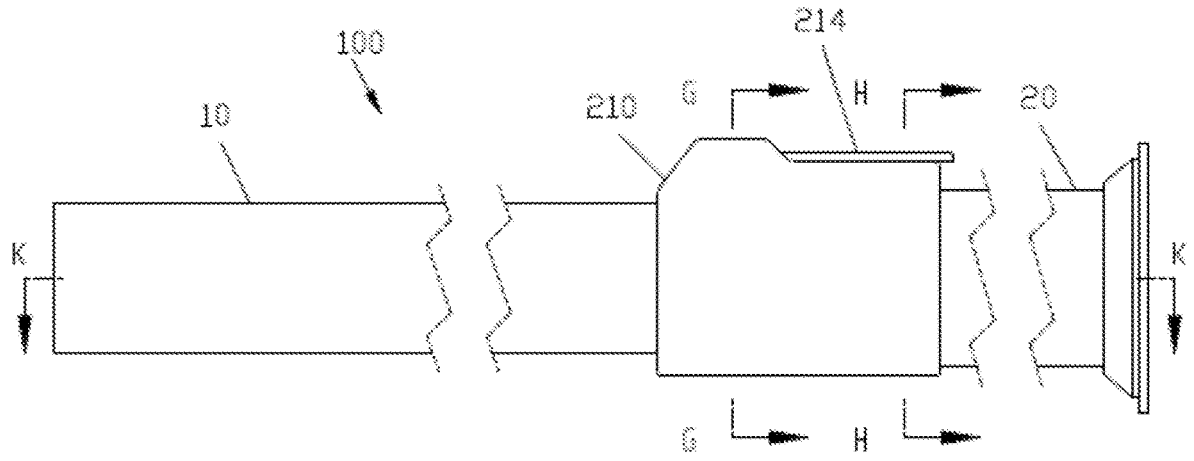
FIG. 15 is a main view of a telescopic stand column of Embodiment 7.
Figure 16:
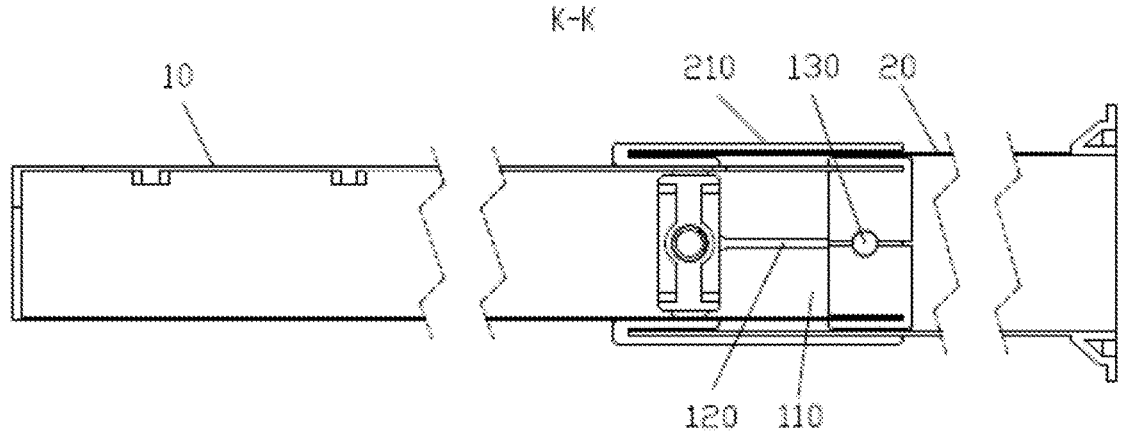
FIG. 16 is a sectional view along Line K-K in FIG. 15.

As shown in FIGS. 13 and 14, the structure of the tent of the present embodiment is substantially the same with that of Embodiment 5, by differing in that: in the present embodiment, the beams 7 are formed by connecting a plurality of double rod structures successively, and no inclined support rod 6 is needed between the beams 7 and the telescopic stand columns 10 or between two beams 7. Each double rod structure comprises two connecting rods 71 disposed in parallel and a vertical rod 72 connecting the two connecting rods 71. Two beams 7 are detachably connected via a connector. After the telescopic stand columns 10 and beams 7 are assembled respectively, the beams are connected to the telescopic stand columns 10, and then the top tent frame 4 is assembled, then the covering fabric 8 is covered on the top tent frame 4, and the telescopic stand columns 10 are locked, to finish the assembly.

Embodiment 7

Referring to FIGS. 15 to 18, the telescopic stand column 100 of the present embodiment comprises an inner tube 10 and an outer tube 20 sleevedly connected to each other, and a lock mechanism fixing the inner tube 10 and the outer tube 20 together. The inner tube 10 has an open end portion 110 inserted into the outer tube 20, and at least one side wall of the inner tube 10 is opened with a strip-shaped opening 120, the strip-shaped opening 120 extends to the edge of the opening along a longitudinal direction. The lock mechanism comprises a tensioning component providing a tensile force to expand the open end portion 110 outward along a direction perpendicular to a length direction of the inner tube 10, and a matching assembly provided within the inner tube 10 to fit with the tensioning component to tension the open end portion 110, and side walls of both the inner tube 10 and outer tube 20 are opened with operation holes corresponding to the tensioning component. Specifically, the inner tube is opened with an operation hole 101, and the outer tube 2 is opened with an operation hole 201.

The inner tube 10 and the outer tube 20 are both square tubes, and in some embodiments, at least two of four side walls of the inner tube 10 are opened with at least one strip-shaped opening 120, respectively, the at least two strip-shaped openings 120 divide the side walls of the open end portion of the inner tube 10 into at least two sidewall deformation portions. For instance, two opposite side walls of the inner tube 10 are opened with at least one strip-shaped opening 120, respectively, the at least two strip-shaped openings 120 divide the side walls of the open end portion of the inner tube 10 into two sidewall deformation portions, and two sides of each sidewall deformation portion respectively comprise a side edge partitioned by the strip-shaped opening 120. The at least two strip-shaped openings 120 opened on the opposite two sides divide the side walls of the open end portion of the inner tube 10 into two U-shaped sidewall deformation portions, two sides of each sidewall deformation portion respectively comprise a corner 170, and each corner 170 comprises at least one of the side edges.

Figure 18:
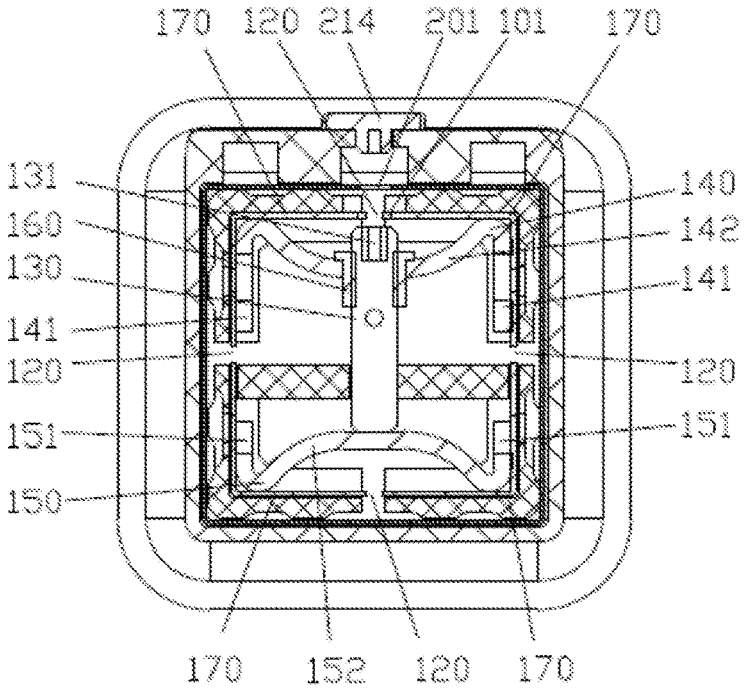
FIG. 18 is a sectional view along Line H-H in FIG. 15.

In the present embodiment, the four side walls of the inner tube 10 are respectively opened with one strip-shaped opening 120, the four strip-shaped openings 120 divide the side walls of the open end portion of the inner tube 10 into two U-shaped sidewall deformation portions, two sides of each sidewall deformation portion respectively comprise a corner 170, and each corner 170 comprises one of the side edges, as shown in FIG. 18. Of course, on the four sides of the inner tube 10, more than one strip-shaped openings 120 may be opened on any side, and the side walls of the open end portion of the inner tube 10 may also be divided into four corners 170.

Wherein, the tensioning component is a screw 130, and the matching assembly comprises a first elastic tensioning piece 140 and a second elastic tensioning piece 150 respectively fixed to two side walls of the open end portion 11, and the screw 130 is movably connected along an axial direction thereof between the first elastic tensioning piece 140 and the second elastic tensioning piece 150, and at least one of the first elastic tensioning piece 140 and the second elastic tensioning piece 150 is threaded connected with the screw 13. For instance, the first elastic tensioning piece 140 and the screw 130 are pressed against each other or fixed together, and the second elastic tensioning piece 150 are threaded connected with the screw 130. Or, the second elastic tensioning piece 150 and the screw 130 are pressed against each other or fixed together, and the first elastic tensioning piece 140 are threaded connected with the screw 130. When rotating the screw 130, the portions of the first elastic tensioning piece 140 and the second elastic tensioning piece 150 contacting with the screw 130 are away from each other or get close to each other.

Figure 17:
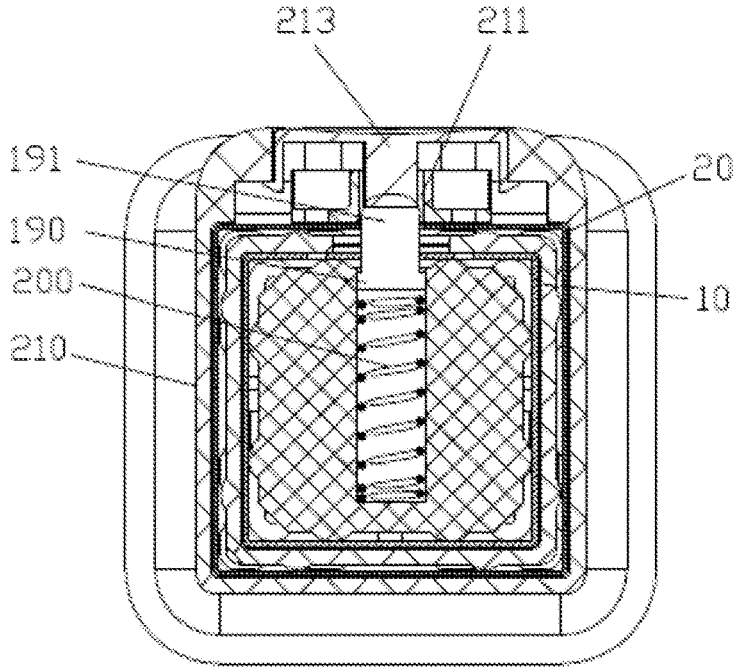
FIG. 17 is a sectional view along Line G-G in FIG. 15.

Two end portions of the first elastic tensioning piece 140 are respectively connected between the two corners 170 of the first sidewall deformation portion, and two end portions of the second elastic tensioning piece 150 are respectively connected between the two corners 170 of the second sidewall deformation portion. In the present embodiment, as shown in FIGS. 17 and 18, the two end portions of the first elastic tensioning piece 140 are respectively connected on two adjacent corners 170 of the four corners 170, and the two end portions of the second elastic tensioning piece 150 are respectively connected on the other two adjacent corners 170 of the four corners 170. In order to increase the frication force between the inner tube 10 and the outer tube 20, the four corners 170 are respectively provided with wear-resistant parts 171 for frictional contact with the inner wall of the outer tube 20, and the wear-resistant parts 171 could be rubber blocks or rubber sleeves.

The first elastic tensioning piece 140 comprises first connecting sections 141 located at two sides and correspondingly connected with two adjacent corners 170, and a first elastic deformation section 142 connected between the first connecting sections 141 of the two sides; the second elastic tensioning piece 150 comprises second connecting sections 151 located at two sides and correspondingly connected with the other two adjacent corners 170, and a second elastic deformation section 152 connected between the second connecting sections 151 of the two sides. In the present embodiment, the first elastic deformation section 142 and the second elastic deformation section 152 are disposed opposing each other and curved inward, respectively, and therefore, the first elastic tensioning piece 140 and the second elastic tensioning piece 150 are in a "M" shape in the present embodiment. The first elastic deformation section 142 and the second elastic deformation section 152 are both arc-shaped.

In order to increase the elastic force and service life of the first elastic tensioning piece 140 and the second elastic tensioning piece 150, the first elastic tensioning piece 140 and the second elastic tensioning piece 150 may formed by integrally curving a metal spring sheet. The connection of the connecting sections 141 and the second connecting sections 151 to the inner walls of the inner tube 10 may be welded connection, clamped connection or bolted connection.

In the present embodiment, a first end portion of the screw 130 is threaded connected with and penetrates through the curved top of the first elastic deformation section 142 of the first elastic tensioning piece 140, and a second end portion of the screw is pressed against the curved top of the second elastic deformation section 152 of the second elastic tensioning piece 150. An internal threaded piece 160 is fixed on the first elastic deformation section 142, and a first end portion of the screw 130 is screw connected to and penetrates through the internal threaded piece 160. The first end portion of the screw 130 is opened with an operation portion, and the operation portion is specifically an internal hexagonal hole 131. When the first end portion of the screw 130 is aligned with the operation hole 201 of the outer tube 20, the screw 130 can be rotated by stretching the internal hexagonal wrench into the operation hole 201 of the outer tube 20 opened corresponding to the screw 130.

When the screw 130 rotates in the forward direction, the force of the second end portion thereof pressing against the second elastic tensioning piece 150 is increased, and the first elastic deformation portion 142 and the second elastic deformation portion 152 are relatively pressed tightly, an at this moment, the curvature of the first elastic deformation section 142 becomes smaller and tends to become straighter, so that the first connecting sections 141 on both sides are away from each other and expand, to drive the two corners 170 of the corresponding U-shaped first sidewall deformation portion to expand with respect to each other and get close to the inner wall of the outer tube 20; at the same time, the curvature of the second elastic deformation section 152 becomes smaller and tends to become straighter too, so that the second connecting sections 151 on both sides are away from each other and expand, to drive the two corners 170 of the corresponding U-shaped second sidewall deformation portion to expand with respect to each other and get close to the inner wall of the outer tube 20, so that the effect is achieved that the four corners 170 are expanded outward along a direction perpendicular to the axial direction of the screw 130 to get close to the outer tube 20, and hence, the open end portion 110 of the inner tube 10 is expanded and get close to and fixed with the outer tube 20.

When the screw 130 rotates in the reverse direction, the force of the second end portion thereof pressing against the second elastic tensioning piece 150 is decreased until it is separated from the second elastic tensioning piece 150, such that the force of the first elastic deformation portion 142 and the second elastic deformation portion 152 pressing tightly against each other decreases until the force disappears, an at this moment, under its own elastic force, the first elastic deformation section 142 tends to become curved and recover to its natural curve, so that the first connecting sections 141 on both sides get close to each other and are restored, and the two corners 170 of the corresponding U-shaped first sidewall deformation portion get close to each other and separate from the inner wall of the outer tube 20; at the same time, under its own elastic force, the second elastic deformation section 152 tends to become curved and recover to its natural curve, so that the second connecting sections 151 on both sides get close to each other and are restored, and the two corners 170 of the corresponding U-shaped second sidewall deformation portion get close to each other and separate from the inner wall of the outer tube 20, so that the effect is achieved that the four corners 170 are drawn inward along a direction perpendicular to the axial direction of the screw 130 and separated from the inner wall of the outer tube 20, and hence, the inner tube 10 and the outer tube 20 are separated and the length thereof may be adjusted by sliding them with respect to each other along the length direction.

In the present embodiment, in order to facilitate locating when adjusting the telescopic position of the inner tube, the inner tube 10 is further provided with an elastic locating piece therein, the elastic locating piece comprises a pin 190 and a spring 200, the pin 190 and the spring 200 are mounted on a guide holder fixedly disposed within the inner tube 10, a side wall of the inner tube 10 is opened with a through hole, an end of the pin 190 has a locating protrusion 191 movably disposed within the through hole of the inner tube 1 and protruding outward, and a side wall of the outer tube 20 is opened with a locating hole fitted with the locating protrusion 191.

The lock mechanism further comprises a housing 210 sleeved on an opening of the outer tube 20, and the housing 210 is opened with a locating auxiliary hole 211 corresponding to the locating hole for receiving the locating protrusion 191. The housing 210 is opened with operation auxiliary holes corresponding to the operation hole 201 on the outer tube 20. The housing 210 is further provided with a button 213 for pressing the locating protrusion 191 to be drawn back inwardly.

When operating to lock the inner tube 10 and the outer tube 20, the inner tube 10 and the outer tube 20 are first adjusted to a suitable length, and then the locating protrusion 191 of the pin 190 leaps from the inner tube 10 and gets stuck in the locating auxiliary hole 211. When the internal hexagonal wrench penetrates the operation auxiliary hole on the housing 210, the operation hole 201 on the outer tube 20 and the operation hole 101 on the inner tube 10 successively, and tightens the screw 130, the force of the screw 130 pressing against the second elastic tensioning piece 150 increases, the first elastic tensioning piece 140 and the second elastic tensioning piece 150 tend to become straight, the four corners 170 of the open end portion of the inner tube 1 are expanded outward, and thus the inner tube 10 and the outer tube 20 are tightly pressed and fixed together.

When operating to unlock the inner tube 10 and the outer tube 20, and loosening the screw 130, the force of the screw 130 pressing against the second elastic tensioning piece 150 decreases, the tightening force between the first elastic tensioning piece 140 and the second elastic tensioning piece 150 decreases, and the first elastic tensioning piece 140 and the second elastic tensioning piece 150 tend to recover to the natural curve, the open end portion of the inner tube 10 are drawn back inward by itself from expansion, the press force between the inner tube 10 and the outer tube 20 becomes very small, and at this moment, by pressing the button 213, the locating protrusion 191 of the pin 190 is retracted back the inner tube 10 from the locating auxiliary hole 211, and then the inner tube 10 and the outer tube 20 may be telescoped and adjusted.

It may further provided a plurality of locating holes and a plurality of operation holes 201 along the length direction of the outer tube 20, for adapting to locating of the inner tube 10 and the outer tube 20 in various of different lengths. During transportation, the inner tube 10 and the outer tube 20 can be contracted to the shortest, or both can be taken apart to reduce the package length.

The diameter of the screw 13 should be greater than the diameter of the operation hole 101 in the inner tube 10, to prevent the screw 130 from coming off. And meanwhile, in order to avoid misoperation, the housing 210 is further provided with an end cover 214 to block the operation hole 201.

After the telescopic stand column 100 of the present embodiment is extended to a longest length, the inner tube 10 and the outer tube 20 are located by using the elastic locating piece (the pin 190 and the spring 200), and by screwing the screw 130 tightly via a tool penetrating into the lock mechanism, the open end portion 110 of the inner tube 10 is expanded outward, the open end portion 110 of the inner tube 10 is pressed against the outer tube 20 after being expanded, so that the inner tube 10 and the outer tube 20 are tightly fastened and fixed together, resulting in that the structure of the telescopic stand column 100 is more stable and the bearing capacity thereof is larger, which can ensure a more stable support effect of the telescopic stand column. When using the telescopic stand column 100, it may be the outer tubes 20 which support on the ground and the inner tubes 10 are located above; it also may be the inner tubes 10 which support on the ground and the outer tubes 20 are located above.

Embodiment 8

Figure 19:
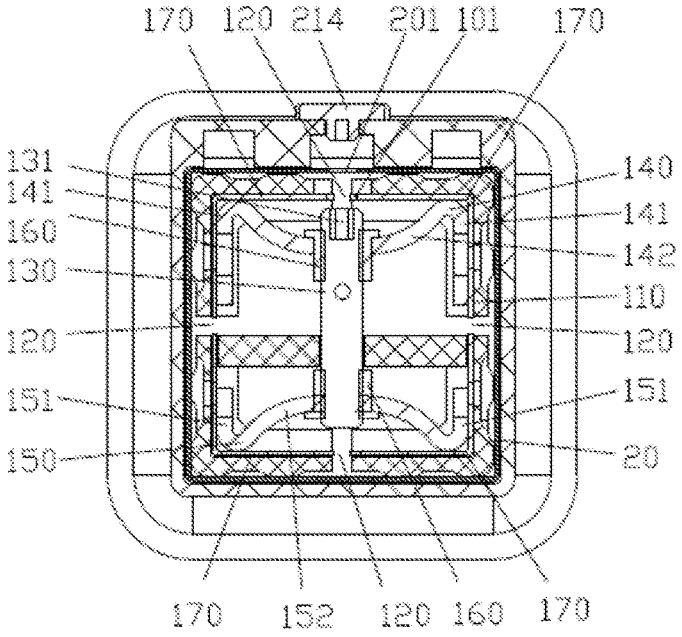
FIG. 19 is a schematic sectional view of a telescopic stand column of Embodiment 8.

The structure of the telescopic stand column of the present embodiment is substantially the same with that of Embodiment 7, by differing in that: the two end portions of the screw 13 are threaded connected with the first elastic tensioning piece 140 and the second elastic tensioning piece 150, the first elastic tensioning piece 140 and the second elastic tensioning piece 150 are respectively provided with an internal threaded piece 160, and the directions of spiral of thread lines on the two end portions of the screw 130 are opposite, as shown in FIG. 19. When the screw 130 rotates in the forward direction, the first elastic deformation portion 142 and the second elastic deformation portion 152 are relatively pressed tightly, such that the effect is achieved that the four corners 170 are expanded outward along a direction perpendicular to the axial direction of the screw 130 to get close to the outer tube 20, and hence, the open end portion 110 of the inner tube 10 is expanded and get close to and fixed with the outer tube 20. When the screw 130 rotates in the reverse direction, the force of the first elastic deformation portion 142 pressing against the second elastic deformation portion 152 decreases, such that the effect is achieved that the four corners 170 are drawn inward along a direction perpendicular to the axial direction of the screw 130 and separated from the inner wall of the outer tube 20, and hence, the inner tube 10 and the outer tube 20 are separated and the length thereof may be adjusted by sliding them with respect to each other along the length direction.

Embodiment 9

Figure 20:
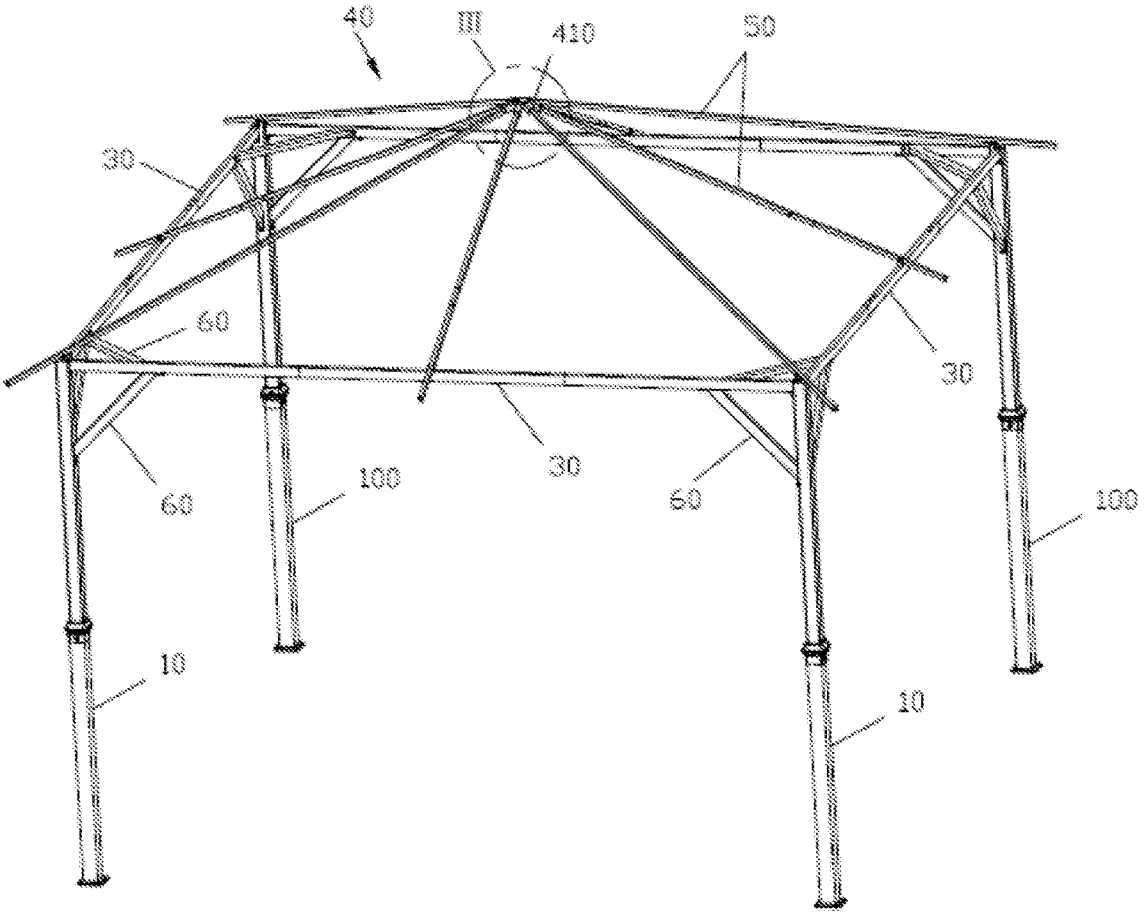
FIG. 20 is a stereo view of a tent (without covering fabric) of Embodiment 9.
Figure 21:
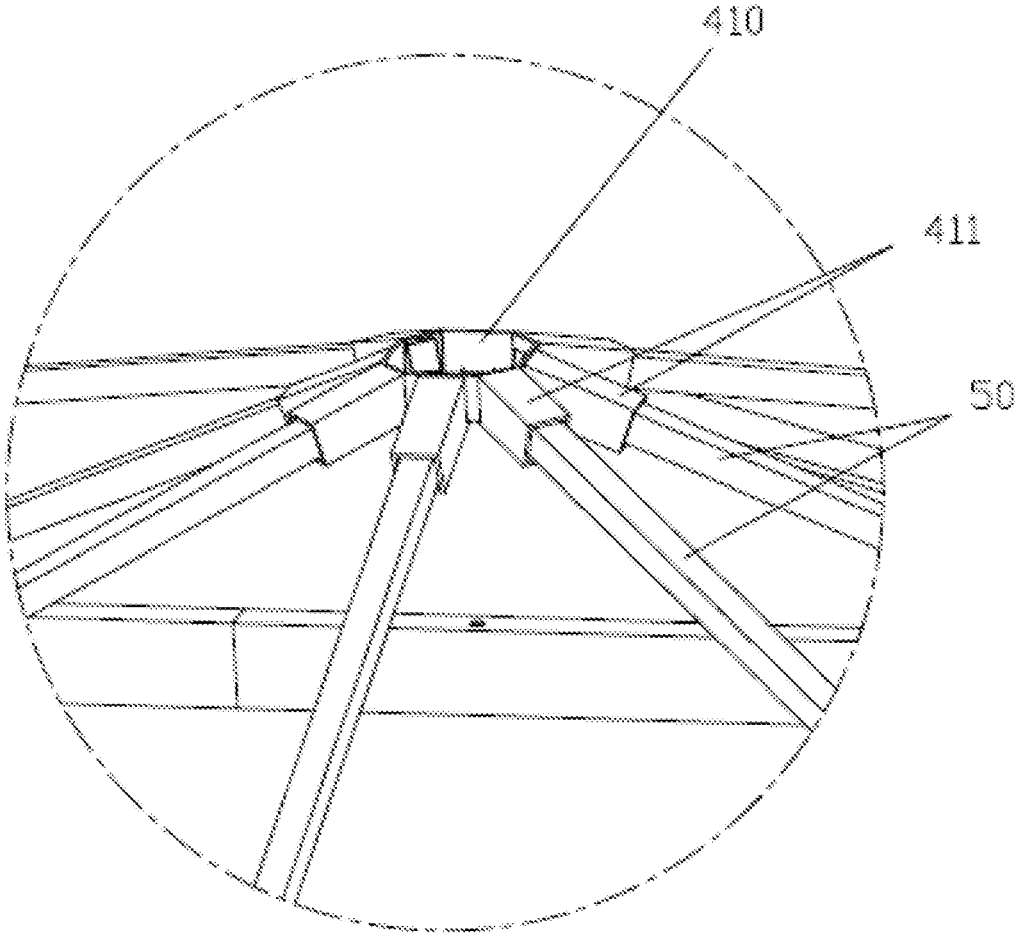
FIG. 21 is an enlarged view of Part Iii in FIG. 20.

As shown in FIGS. 20 and 21, the present embodiment provides a tent, comprising beams 30, a top tent frame 40 and covering fabric, and it further comprises the telescopic stand column 100 of Embodiment 7 or 8, wherein there are four telescopic stand columns 100, and the beams 30 are connected between two telescopic stand columns 100, respectively. Two telescopic stand columns 100 are connected via one beam 30, and the four telescopic stand columns 100 are connected via four beams 30 successively to form a cubic frame. The top tent frame 40 is fixed on the cubic frame formed by the telescopic stand columns 100 and the beams 30, and the top tent frame 40 comprises a top connector 410 and a plurality of top rods 50 connected to the top connector 410. Specifically, in the present embodiment, the top connector 410 is provided with a plurality of connecting interfaces 411, the upper end of each top rod 50 is connected to one corresponding connecting interface 411 and each of the top rods 50 extends aslant downward; lower portions of some of the plurality of top rods 50 are connected to upper ends of the telescopic stand columns 100, and lower portions of the rest top rods 50 are connected to the beams 30. In the present embodiment, there are eight top rods 50, wherein four top rods 50 are connected to the top connector 410 and respectively to the upper end of corresponding one of the telescopic stand columns 100, and the other four top rods 50 are connected to the top connector 410 and respectively to the middle of the corresponding one of the beams 30.

Wherein, the beams 30 are all formed by connecting a plurality of connecting rods successively. Each beam 30 and telescopic stand column 100 are provided with an inclined support rod 60. The two beams 2 connected to the same telescopic stand column 100 are perpendicular to each other, and the two beams 2 are also provided with an inclined support rod 60. The two inclined support rods 60 on the same telescopic stand column 100, and the inclined support rod 60 between the two beams 2 on the same telescopic stand column 100 form a triangle. The connection of the inclined support rods 60 may strengthen the strength of the cubic frame, causes the integral structure more stable. In order to facilitate the packaging and transportation, the top rods 60 are also formed by connecting a plurality of connecting rods successively.

When assembling the tent of the present embodiment, the assembly can be completed by only two people, the telescopic columns 100 are assembled first, and the telescopic columns 100 are contracted to the shortest length, and then the beams 30 are connected between the telescopic stand columns 100 to form a cubic frame, then, the assembled top tent frame 40 is mounted on the cubic frame, the covering fabric is covered thereon, and then the length of the telescopic columns 100 is elongated, and then the telescopic stand columns 100 are locked by the lock mechanism, to finish the assembly of the tent, which is very convenient. Since each of the telescopic stand columns 100 is telescopic, the beams 30 and the top rods 50 can also be detached into parts with shorter length, which greatly reduces the packaging volume and is convenient for transportation and storage.

The embodiments described above are only for illustrating the technical concepts and features of the present disclosure, and are intended to make those skilled in the art being able to understand the present disclosure and thereby implement it, and should not be concluded to limit the protective scope of this disclosure. Any equivalent variations or modifications according to the spirit of the present disclosure should be covered by the protective scope of the present disclosure.

What is claimed is:

1. A tent, comprising beams, a top tent frame and at least three telescopic stand columns, each telescopic stand column comprises an inner tube and an outer tube sleevedly connected to each other such that the telescopic stand columns are capable of being extended, and a lock mechanism fixing the inner tube and the outer tube together, wherein the inner tube has an open end portion inserted into the outer tube, and at least one side wall of the open end portion is opened with a strip-shaped opening, the lock mechanism comprises a tensioning component providing a tensile force to expand the open end portion outward along a direction perpendicular to a length direction of the inner tube, and a matching assembly provided within the inner tube to fit with the tensioning component to tension the open end portion, and side walls of both the inner tube and outer tube are opened with operation holes corresponding to the tensioning component, further wherein the matching assembly comprises a first stop block and a second stop block, respectively fixed to two side walls of the open end portion, and the tensioning component is movably connected along its own axial direction between the first stop block and the second stop block, and at least one of the first stop block and the second stop block is provided with a groove, an internal threaded piece is provided inside the groove, the tensioning component movably penetrates into the groove, and the internal threaded piece is threaded connected with the tensioning component; and wherein the inner tube has a section having at least three side walls, at least one of the side walls is provided with one said strip-shaped opening, the first stop block is fixed at a corner formed by two adjacent side walls, the second stop block is fixed at the rest side wall(s).

2. The tent according to claim 1, wherein the tensioning component is a screw.

3. The tent according to claim 2, wherein both the first stop block and the second stop block are provided with grooves, two ends of the screw movably penetrate into the groove of the first stop block and the groove of the second stop block, respectively, and at least one of the groove of the first stop block and the groove of the second stop block is provided with an internal threaded piece threaded connected with the screw.

4. The tent according to claim 1, wherein the section is triangle or pentagon shaped, at least a first and/or second side wall is provided with one said strip-shaped opening, the first stop block is fixed at a corner formed by the first and second side walls, the second stop block is fixed at a third side wall opposite to the corner.

5. The tent according to claim 1, wherein two ends of the tensioning component are threaded connected with the first stop block and the second stop block, respectively, and directions of spiral of thread lines on the two ends of the tensioning component are opposite.

6. The tent according to claim 5, wherein both the first stop block and the second stop block are provided with grooves, two ends of the tensioning component movably penetrate into the groove of the first stop block and the groove of the second stop block, respectively, the groove of the first stop block is provided with a first internal threaded piece therein, the groove of the second stop block is provided with a second internal threaded piece therein, an end of the tensioning component is threaded connected with the first internal threaded piece, and the other end of the tensioning component is threaded connected with the second internal threaded piece.

7. The tent according to claim 1, wherein the inner tube is further provided with an elastic locating piece therein, a side wall of the inner tube is opened with a through hole, the elastic locating piece has a locating protrusion movably disposed in the through hole and protruding outward, and a side wall of the outer tube is opened with a locating hole fitted with the locating protrusion.

8. The tent according to claim 7, wherein the elastic locating piece is a spring leaf, one end portion of the spring leaf is pressed against the side wall of the inner tube, and the other end portion of the spring leaf is integrally curved to form the locating protrusion.

9. The tent according to claim 7, wherein the elastic locating piece comprises a locating pin and a spring disposed within the inner tube, and one end of the locating pin has the locating protrusion.

10. The tent according to claim 7, wherein the lock mechanism further comprises a housing sleeved on an opening of the outer tube, and the housing is opened with a locating auxiliary hole corresponding to the locating hole on the outer tube for receiving the locating protrusion; the housing is opened with operation auxiliary holes corresponding to the operation holes.

* * * * *